United States Patent [19]

Mitter

[11] 4,155,229

[45] May 22, 1979

[54] PRINTING APPARATUS

[76] Inventor: Mathias Mitter, Falkenstrasse 57, 4815 Schloss Holte, Fed. Rep. of Germany

[21] Appl. No.: 829,985

[22] Filed: Sep. 1, 1977

Related U.S. Application Data

[63] Continuation-in-part of Ser. No. 735,198, Oct. 26, 1976, Pat. No. 4,109,483.

[30] Foreign Application Priority Data

| | | | |
|---|---|---|---|
| Feb. 27, 1976 | [DE] | Fed. Rep. of Germany | 2608005 |
| Sep. 7, 1976 | [DE] | Fed. Rep. of Germany | 2640132 |
| Nov. 23, 1976 | [DE] | Fed. Rep. of Germany | 2653162 |

[51] Int. Cl.[2] ..... D06B 1/08

[52] U.S. Cl. ..... 68/200; 101/26; 101/103; 118/211; 118/243; 346/140 R; 400/103; 400/124

[58] Field of Search ..... 68/200, 201, 205 R; 118/211, 243, 263, 37; 101/26, 103; 400/103, 124; 346/140 R

[56] References Cited

U.S. PATENT DOCUMENTS

| | | | |
|---|---|---|---|
| 681,121 | 8/1901 | Hudson | 101/26 |
| 1,360,823 | 11/1920 | Thwing | 346/140 X |
| 1,915,779 | 6/1933 | Gere | 68/205 X |
| 2,567,308 | 9/1951 | Wockenfuss | 101/103 |
| 3,122,039 | 2/1964 | Sowers | 101/26 X |
| 3,302,562 | 2/1967 | Nelson | 101/103 |
| 3,329,964 | 7/1967 | Mutschler et al. | 118/243 X |

*Primary Examiner*—Philip R. Coe
*Attorney, Agent, or Firm*—Michael J. Striker

[57] ABSTRACT

A plurality of sleeves extends through a printing-medium chamber; each sleeve has one or more openings through which its interior can communicate with the chamber. In each sleeve a plunger is reciprocable between a retracted position in which the opening is exposed so that printing medium can enter from the chamber, and a printing position in which the plunger closes the opening and the printing medium in the sleeve is applied to a workpiece. A drive reciprocates the plungers individually. The chamber may be pressurized to cause more rapid entry of printing medium into the sleeves. The quantity of printing medium applied during each plunger reciprocation may be selectively varied.

28 Claims, 9 Drawing Figures

324
224
124
24
26
1
1
114
13
111
3
1
40
14
111
14a
1
111
14
24
4

1
2
3
4
5
40
50
53
120
150
250

1
2
4
5
6
33
40
41
42
43
50
51
52
53
150
V
V
St

PRINTING APPARATUS

CROSS-REFERENCE TO RELATED APPLICATION

This is a continuation-in-part of copending application Ser. No. 735,198 of Mathias MITTER, filed Oct. 26, 1976, and now U.S. Pat. No. 4,109,483.

BACKGROUND OF THE INVENTION

The present invention relates to a printing machine.

More particularly, the invention relates to a printing machine having individual printing plungers.

Copending application Ser. No. 735,198, now U.S. pat. No. 4,109,483 the entire content of which is incorporated by reference herein, discloses a printing machine in which individual plungers entrain printing medium and apply dots or spots of the same onto a workpiece. The printed-on dots preferably run together or generally overlap, so that the machine can produce a continuous printed surface. The plungers are reciprocable and can be moved individually or in groups; it is possible to select different plungers to make up a group, so that different patterns can be printed by selecting different plungers.

This machine relies upon the printing-medium entraining capacity of each plunger for the amount of printing medium which can be applied during each printing operation of each plunger. There are, however, circumstances where it is desired to be able to apply more than the usual amount of printing medium, e.g., if a high-nap textile is to be printed. The machine disclosed in the copending application cannot be adjusted to make this possible.

SUMMARY OF THE INVENTION

Accordingly, it is an object of the present invention to provide further improvements in a plunger-type printing machine.

A more specific object is to provide such a machine wherein the amount of printing medium applied to a workpiece by reciprocation of the plungers during a respective printing operation can be varied as desired.

Another object is to provide such a machine wherein the printing speed is increased as compared to the machine disclosed in the copending application.

In pursuance of these objects and of others which will become apparent hereafter, one feature of the invention resides in a printing apparatus which, briefly stated, may comprise means for supporting a web to be printed; means forming a chamber for a body of printing medium and in part bounded by a wall juxtaposed with the supporting means; a plurality of sleeves extending through the chamber and each having an open end facing the supporting means and a port inwardly spaced from the open end by a predetermined distance and communicating its interior with the chamber; a plurality of plungers each reciprocably received in one of the sleeves and each having a leading end, the plungers each being movable between a retracted position in which the leading end at least in part uncovers the associated port so that printing medium can enter the sleeve and an advanced printing position in which the leading end is located forwardly of the associated port and the plunger closes the same; and means for reciprocating the plungers individually between the positions thereof.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
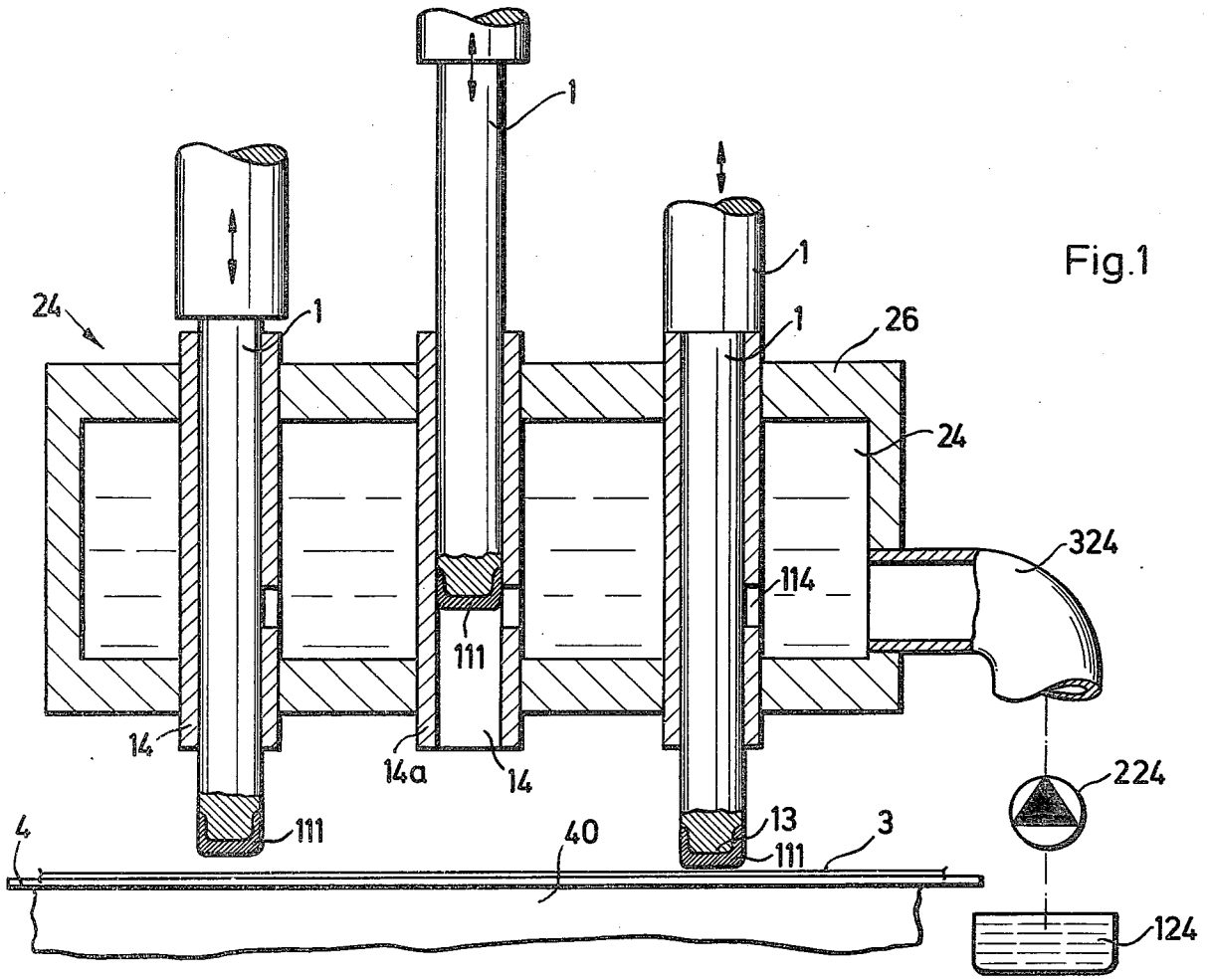
FIG. 1 is a fragmentary sectioned side view, showing one embodiment of the invention.
Figure 4:
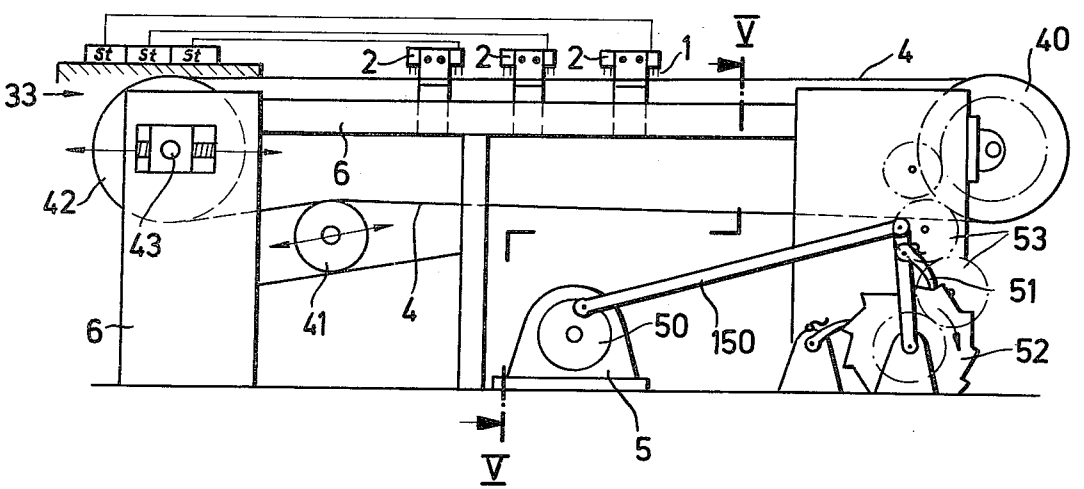
FIG. 4 is a diagrammatic side view of a printing machine incorporating the invention.

One embodiment of the invention is illustrated in FIG. 1 wherein reference numeral 26 identifies a pattern element (e.g., beam or box-shaped) which defines a printing-medium chamber 24 in its interior. The element 26 may extend over the entire width of a workpiece (e.g., web) to be printed, as shown in FIG. 4. Sleeves 14 extend through the chamber 24, preferably over the entire height of the same. These are each provided within the chamber 24 (below the normal level of printing medium if the chamber is not maintained completely filled) with at least one opening 114 which communicates the chamber 24 with the interior **14*a* of the respective sleeve 14**.

Each sleeve 14 accommodates a printing element in form of a plunger 1 which is reciprocable in upright direction (see the double-headed arrows). Thus, when the plungers 1 are withdrawn upwardly to a position in which their front ends at least partly expose the respective opening 114, printing medium can enter through this opening from chamber 24 into the interior **14*a* of the respective sleeve 14**.

Chamber 24 communicates via one or more (one shown) conduits 324 with a continuously variable (variable-output) pump 224 whose intake in turn communicates with a printing-medium reservoir 124. The pump 224 is of the variable-output type to be able to accommodate its operation to different types of printing medium. For example, if the printing medium is viscous or very viscous (e.g., paste-like), then a relatively substantial amount of pressure needs to be maintained in the chamber 24. If, however, the medium is of low viscosity (e.g., ink), then it will usually suffice to maintain the medium at a predetermined level in the chamber 24 rather than to pressurize the latter; the pump 224 then need only maintain the level constant or substantially constant since the pressure head of the (low-viscosity) liquid will be adequate to cause the liquid to enter through the openings 114.

The plungers 1 are reciprocable between an upper retracted position in which their lower end faces 13 are located upwardly spaced from the lower edge 114*a* of the associated opening 114 (thus permitting entry of printing medium from chamber 24) and a lower printing position in which the circumference of the respective plunger blocks the opening 114. The lower end of the respective plunger 1 may be configurated as a stamping pad 111 which "stamps" a printing-medium spot onto the workpiece 3. However, instead of actually having the pads 111 (or the end faces 13) engage the workpiece 3, the plungers 1 can be reciprocated simply to open and close the openings or ports 114; if so, the quantity of printing medium which has entered the respective sleeve 14 while the port 114 was open, will then be expelled during the (downward) printing stroke of the plunger and will flow or drop onto the workpiece 3. If the printing medium has low viscosity, it will simply flow in through opening 114 and out through the lower open end of sleeve 1 (and onto workpiece 3) while the opening 114 is exposed; in such case the downward movement of plunger 1 then serves merely to close the opening 114 and terminate the flow.

The workpiece 3 may be supported on a supporting table or counterpressure beam 40, and a printing blanket 4 (movable continuously and/or intermittently) may be interposed between the table 40 and the workpiece 3 and support the latter.

Figure 2:
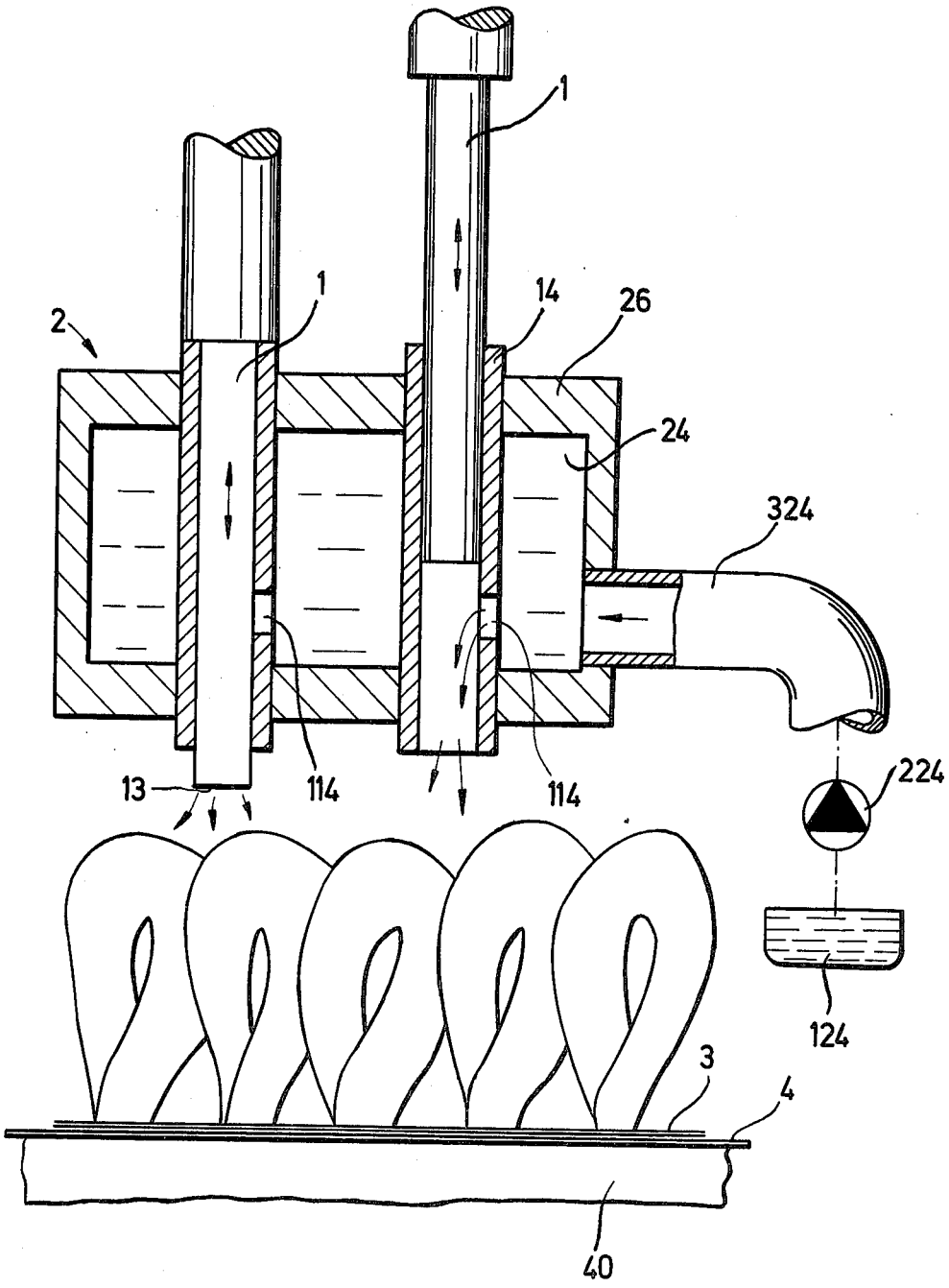
FIG. 2 is a view similar to FIG. 1 but showing a further embodiment.

The plungers 1 can be reciprocated at very high speed, especially if the embodiment of FIG. 2 is used which differs from FIG. 1 only in that the plungers 1 expel the printing medium onto the workpiece 3 but do not physically contact the latter. The plungers may perform 3000 reciprocations per minute, or even 10,000 or more. Assuming 1,000 reciprocations per minute and intermittent advancement of the workpiece 3 (e.g., by movement of the printing blanket) in steps of 2 mm, a two-meter length of the workpiece can be printed per minute. Of course, the higher the number of reciprocations and intermittent (or else continuous) advancing speed of the workpiece, the greater the workpiece length which can be printed per minute.

Figure 3:
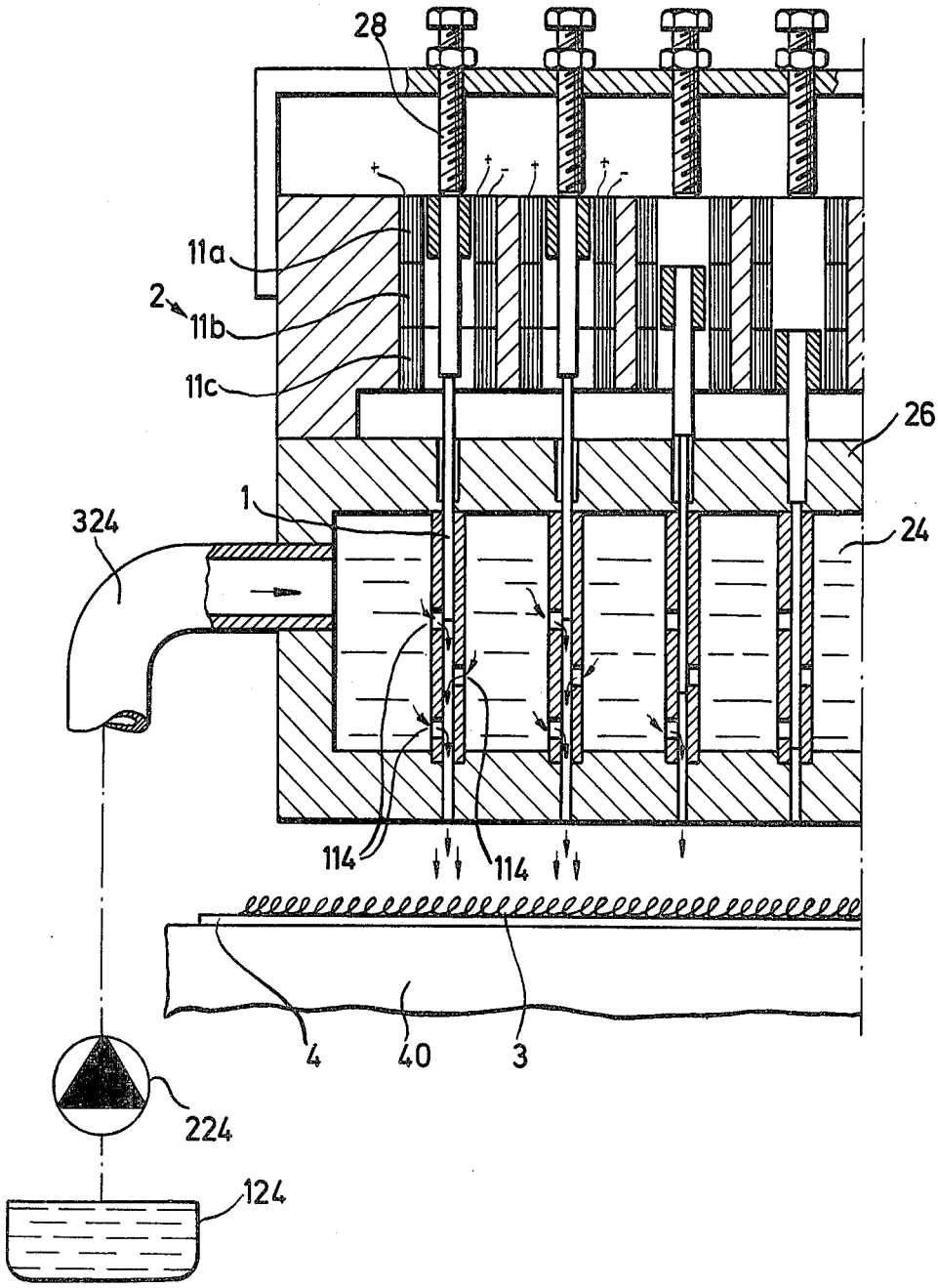
FIG. 3 is a fragmentary sectional side view illustrating means for controlling reciprocation of the printing plungers.

The embodiment of FIG. 3 shows that different plungers 1 can be raised to different extents, so that a different number of openings 114 is unblocked. In this embodiment the element 26 carries the means for reciprocating the plungers 1, here in form of magnets 11*a*, 11*b*, 11*c* (e.g., solenoids). When the plungers 1 are raised (retracted) printing medium flows through the exposed openings 114 into the sleeves 1 and onto the workpiece 3; during advancement (lowering) of the plungers the openings 114 are closed and residual printing medium is expelled from the sleeves. The plungers 1 could also move into physical printing contact with the workpiece.

The magnets (e.g. solenoids) 11*a*, 11*b*, 11*c* can be individually energized to raise the plungers 1 to a desired level. When the plungers are to be raised to the highest level, then the associated solenoids 11*a* and 11*b* are jointly energized. The decision which of the solenoids of which of the plungers to energize and de-energize may be controlled by a program-control, e.g., a computer (details of such a control are not part of this invention and are, in any case, known per se). It is preferable if the solenoids of each plunger can be separately and selectively energized, since this permits sizes and compositions of patterns to be changed (e.g., in dependence upon the size of the workpiece, or the size of the printing run in terms of meters) from case to case or even continuously, without requiring changes in the machine itself (only the control device needs to be reprogrammed or preprogrammed).

The control device can be controlled by punchcards or magnetic tapes or the like. This is known from the control devices used e.g., for pattern-control in Jacguard machines. Merely for the sake of identification such control devices ST are shown diagrammatically (in box form) in FIG. 4.

In their uppermost end postion the plungers 1 abut against adjusting screws 28 (FIG. 3) which can be raised or lowered to vary this end position. To prevent the plungers from being raised beyond the middle (intermediate) position the screws 28 can be lowered further than shown in FIG. 3.

Figure 5:
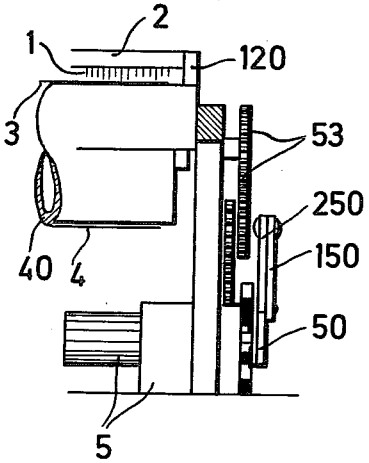
FIG. 5 is a fragmentary section on line V—V of FIG. 4.

FIGS. 4 and 5 show an embodiment in which the workpiece is advanced intermittently (towards the right in FIG. 4). It has three of the elements 2 which are arranged above the work plane 33 in which the workpiece 3 is advanced by the printing blanket 4. The latter is driven by a roller 40; it is trained about this roller 40 as well as about a tension-regulating roller 41 and a reversing roller 42 which is provided with a printing-blanket tensioning device 43.

The machine drive includes a prime mover 5 which rotates a crank wheel 50. A crank 150 is pivoted to the wheel 50 and to a drive train 53; the pivotal link 250 of crank 150 carries a pawl 51 which drives a ratchet wheel 52. Drive train 53 transmits motion to roller 40.

The machine frame 6 has laterally arranged stationary uprights 120 which support the ends of the elements 2. These, in turn, are provided with the plungers 1 (as disclosed in other embodiments herein); the plungers of each element 2 are controlled by one of the devices ST.

Further details of the machine are disclosed in copending application Ser. No. 735,198 but it should be understood that the showing in FIGS. 4 and 5 is only exemplary and not to be considered limiting.

Figure 6:
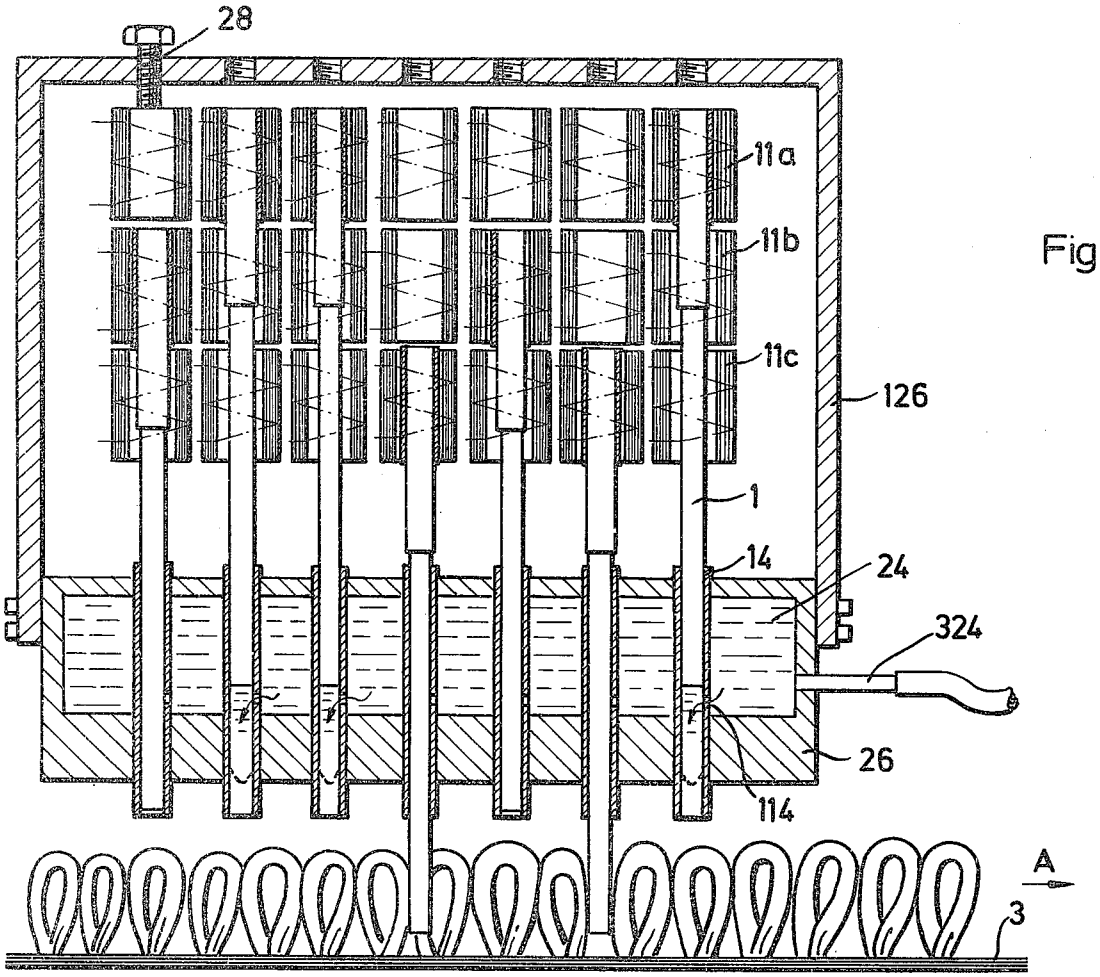
FIG. 6 is a vertical section through an apparatus according to the invention, illustrating it during printing operation.

The embodiment of FIG. 6 shows an element 26 having plungers 1 which can be reciprocated downwardly to a printing position in which their lower ends penetrate into the nap of a workpiece 3 which is being advanced in the direction A. In other respects this embodiment corresponds to the one in FIG. 3.

Figure 9:
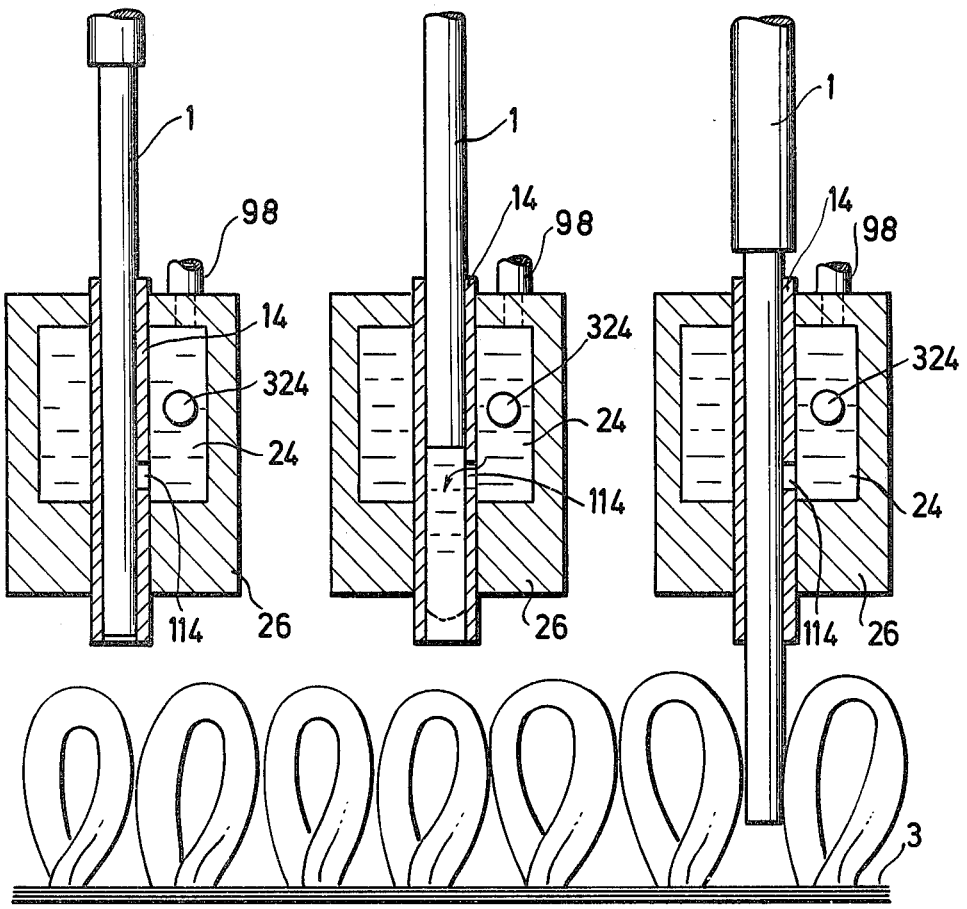
FIG. 9 is a somewhat diagrammatic side view, partly sectioned, illustrating different plunger positions.

FIG. 6 should be considered in conjunction with FIG. 9 which illustrates the major plunger positions of the FIG. 6 embodiment on an enlarged scale. The left-hand plunger 1 in FIG. 9 is shown in its "rest position" (no printing takes place); the center plunger is shown in the "printing-medium admitting position" and the right-hand plunger in the "printing position". The downwardly pendant broken lines in the sleeves 14 of FIGS. 6 and 9 indicate the quantity of printing medium in the sleeves prior to expulsion; it remains in the sleeves until expulsion by the plungers 1 due to its viscosity. While a high-nap (looped-nap) workpiece 3 (e.g., carpet or other textile) has been shown, the nap could of course be different (e.g., velour) or the workpiece could be smooth (have no nap).

Figures 7, 8:
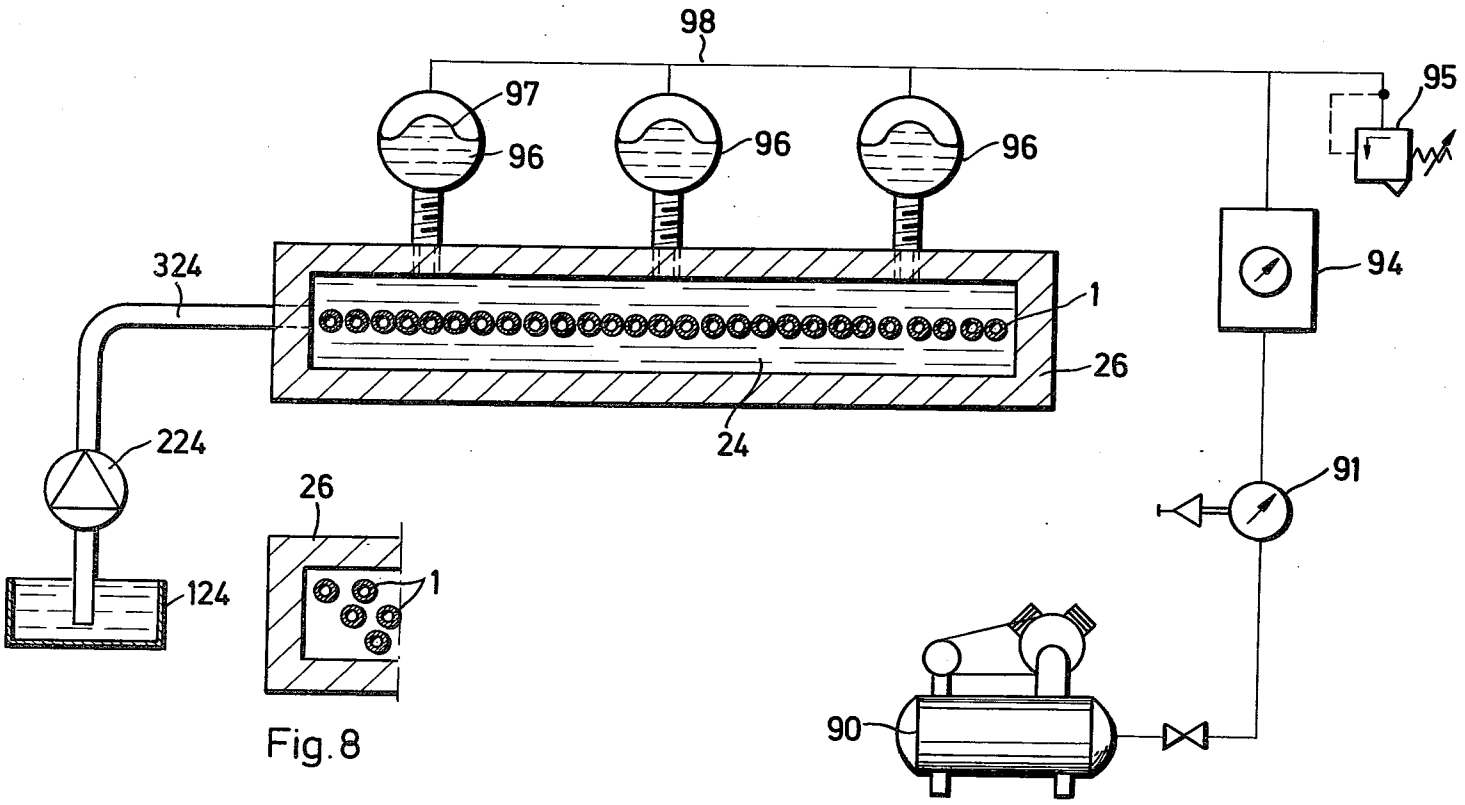
FIG. 7 is a partly sectioned diagrammatic top-plan view of an apparatus embodying the invention.
FIG. 8 is a fragmentary section, in top view, of an embodiment which differs somewhat from the one shown in FIG. 7.

FIGS. 7 and 8, finally, show the arrangement of the plungers 1 in the element 26. In FIG. 7 the plungers 1 are arranged in a straight row, but FIG. 8 shows that they could also be staggered. Printing medium is supplied to chamber 24 via continuously variable pump 224 which draws it from reservoir 124. If additional pressure is needed in chamber 24 beyond that supplied by pump 224, a compressor 90 may be connected with the chamber 24 via a gauge 91, a pressure regulator 94, a pressure limiting device 95 and pressure accumulators 96. These latter are devices having a housing whose interior is subdivided by a flexible diaphragm 97 into two compartments. One of these compartments communicates via line 98 with the compressor 90; the other compartment contains printing medium and communicates with chamber 24. The use of the devices 96 makes it possible to obtain (and maintain) a uniform pressure over the entire width (as considered in longitudinal direction of element 26) of the chamber 24.

The movements of plungers 1 are program-controlled, as mentioned before. The workpiece 3 can be advanced continuously or intermittently in the direction of arrow A (FIG. 6). If desired, however, the workpiece could be stationary and the element 26 could be moved to and fro lengthwise and/or transversely over the workpiece (or movements of workpiece and element 26 could be combined) and the element could be raised and lowered in a desired sequence or rhythm.

Evidently, in all embodiments the flow of printing medium into the sleeves 14 will vary, depending upon whether the plungers 1 unblock the openings 114 partially or completely. This permits a control of the amount of printing medium being applied during each plunger reciprocation. The higher the pressure in chamber 24 and/or the lower the viscosity of the printing medium, the more printing medium will pass through the unblocked openings per unit time. This, and also the possibility to vary the reciprocating speed of the plungers, makes it possible to select the amount of printing medium being applied to the workpiece. Thus, even a high-napped textile can be supplied with sufficient printing medium for proper penetration of the printing medium to the base material of the workpiece.

Of course, two or more openings 114 may be provided in each (or some) of the sleeves 14 at different vertically spaced levels, as shown in FIG. 3. Thus, the amount of incoming printing medium can be varied in dependence upon how many of these openings are unblocked by the associated plunger.

The amount of printing medium which enters the respective sleeve 14 is determined by several factors, namely: the time for which the opening 114 is unblocked, the pressure in chamber 24, the cross-sectional area of the single or multiple openings 114 of each sleeve 14 and the proportion of this area which is unblocked by the plunger 1, the viscosity of the printing medium and the volumetric capacity of the sleeve 14 which can be varied by retracting the plunger 1 to a greater or lesser extent. The most important of these is the time for which the opening is unblocked, i.e., the time during which the plunger remains in its retracted position. The plunger can, if desired, be retained in its retracted position for whatever time is determined (e.g., empirically) to be required for the printing madium to completely or partially fill the associated sleeve. This can be of particular importance in the case of very viscous printing media. It is important to be able to control the amount of printing medium which enters the sleeve during each reciprocation, since the quantity of medium to be applied to the workpiece varies from case to case, in dependence upon the absorption capability of the workpiece, the type of printing medium, and the aesthetic impression which is to be created by the printed pattern.

If a highly viscous medium is used, it will not drip out of the open end of the sleeve and will be retained therein (capillary action, surface tension) until it is forcibly expelled by the plunger. Of course, this depends in part upon the inner diameter of the sleeve 1, which is advantageously on the order of 0.5–2 mm. The use of the accumulators 96 (FIG. 7) is especially advantageous when high-viscosity medium is employed, because it assures uniform filling of all sleeves 14 associated with a respective chamber 24, since it provides for uniform pressure upon the medium in all parts of the chamber.

Although in the several embodiments the plungers 1 are shown to reciprocate vertically, it should be understood that a different direction of recipocation (e.g., inclined to the vertical) is also possible. OF course, vertical reciprocation and printing is very advantageous and will be used most commonly.

Since the amount of printing medium entering the sleeves during each reciprocation can be very well controlled, it is possible to admit only a small quantity during each reciprocation if the workpiece has e.g., a smooth surface (paper, plastic foil, or the like). However, when the type of workpiece (e.g., shag rug) and/or the pattern to be printed warrants or requires large quantities of printing medium, such quantities can also be supplied. If desired (e.g., in the case of high-nap textiles) the front ends of the plungers can be made to penetrate into the nap, so as to carry the printing medium deep into the nap and even to the base of the textiles (e.g., the jute back of a rug).

The printing medium can self-evidently be a printing ink of any desired color. However, it need not be an ink and it could be colorless. For example, the medium could be a plastic, an adhesive or a chemical (e.g., for fire-proofing, moth-proofing or for any desired purpose).

The invention is, of course, not limited to the illustrated embodiment. For example, instead of plungers and sleeves of round cross-section it would be possible to use such elements which have e.g., an oval or a polygonal cross-section. The means for effecting the plunger reciprocation could also be other than the illustrated magnets. What is important is that it must be possible to vary the pattern as desired and that it must be possible to print a continuous pattern (i.e., not merely a raster-pattern composed of spaced-apart spots, although this is not excluded) of one or more colors or of one or more other printing media. If the medium is a coloring medium (e.g., ink) it is then possible to produce even a unicolored workpiece by simply printing with one color over the entire surface area of the workpiece.

While the invention has been illustrated and described as embodied in a printing apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of th generic or specific aspects of this invention.

What is claimed as new and desired to be protected by Letters Patent is set forth in the appended claims.

1. A printing apparatus, comprising means for supporting a web to be printed; means forming a chamber for a body of printing medium and in part bounded by a wall juxtaposed with said supporting means; a plurality of sleeves extending through said chamber and each having an open end facing said supporting means and a port inwardly spaced from said open end by a predetermined distance and communicating its interior with said chamber; a plurality of plungers each reciprocably received in one of said sleeves and each having a leading end, said plungers each being movable between a retracted position in which said leading end at least in part uncovers the associated port so that printing medium can enter the sleeve and an advanced printing position in which said leading end is located forwardly of the associated port and the plunger closes the same; and means for reciprocating said plungers individually between said positions thereof.

2. A printing apparatus as defined in claim 1, wherein each of said sleeves is provided with at least one additional port spaced lengthwise of the respective sleeve from the first-mentioned port.

3. A printing apparatus as defined in claim 2, said reciprocating means being selectively operable to effect reciprocation of respective plungers to and from said retracted position and to and from an additional retracted position in which latter said leading end uncovers both of said ports.

4. A printing apparatus as defined in claim 1, wherein each of said sleeves is provided with at least one additional port spaced from said open end by substantially said predetermined distance.

5. A printing apparatus as defined in claim 1; further comprising a variable-output pump for supplying printing medium to said chamber; and conduit means connecting said pump with said chamber.

6. A printing apparatus as defined in claim 1, said chamber being a pressurizable chamber; further comprising a variable-output pump for supplying printing medium under pressure into said chamber; and conduit means connecting said pump with said chamber.

7. A printing apparatus as defined in claim 1; and further comprising control means for controlling the operation of said reciprocating means to reciprocate said plungers singly or in groups.

8. A printing apparatus as defined in claim 1, wherein said plungers are sealingly received in the associated sleeves to operate analogously to pump pistons.

9. A printing apparatus as defined in claim 1, wherein said leading ends of said plungers are pointed.

10. A printing apparatus as defined in claim 1, wherein said reciprocating means comprise devices for reciprocating said plungers at high speed.

11. A printing apparatus as defined in claim 1, wherein said leading ends contact a web on said supporting means when said plungers are in said printing position.

12. A printing apparatus as defined in claim 1, wherein said leading ends penetrate at least in part into a web on said supporting means when said plungers are in said printing position.

13. A printing apparatus as defined in claim 1, said chamber-forming means comprising an elongated working beam; and further comprising means on said beam for pressurizing the body of printing medium in said chamber.

14. A printing apparatus as defined in claim 13, said pressurizing means comprising a plurality of pneumatic springs.

15. A printing apparatus as defined in claim 13, said pressurizing means comprising a plurality of hydraulic springs.

16. A printing apparatus as defined in claim 13, said pressurizing means comprising a plurality of devices each having a fluid-filled container provided with an open side, and adapted to bear upon the printing medium in said chamber so as to transmit thereto pressure from the fluid in said container.

17. A printing apparatus as defined in claim 16; further comprising a pump having a continuously variable output and being connected with said chamber.

18. A printing apparatus as defined in claim 16; further comprising means for pressurizing the fluid in said containers.

19. A printing apparatus as defined in claim 18, said pressurizing means including means for generating pressure and applying it to the fluid in said containers, and means for maintaining said pressure at a selected level.

20. A printing apparatus as defined in claim 16, said plungers each having a leading end which is in contact with the web to be printed when the respective plunger is in said printing position thereof.

21. A printing apparatus as defined in claim 16, said plungers each having a leading end which at least partly penetrates the web to be printed when the respective plunger is in said printing position thereof.

22. A printing apparatus as defined in claim 1, said reciprocating means comprising means for temporarily arresting the respective plungers in said retracted position for selectable periods of time to permit filling of the associated sleeve with printing medium prior to movement of the plunger to said printing position thereof.

23. A printing apparatus as defined in claim 1, wherein the volumetric content of each of said sleeves is selected in accordance with the printing-medium absorbing ability of a web which it is intended to print.

24. An apparatus for printing on a web, comprising means for confining a body of printing medium; a plurality of plungers; means mounting the plungers for reciprocation towards and away from the general plane of the web and through the body of printing medium, including sleeves in which the respective plungers reciprocate and which each communicate with said body and each have an open end facing the web; means for retracting said plungers in direction away from the web in the respective sleeves so as to segregate from the body of printing medium a metered amount of such medium, and for thereafter advancing the plungers towards the web; and means for applying segregated printing medium to the web on advancing of the plungers, including a portion of each plunger which expels the segregated printing medium through the respective open end onto the web.

25. An apparatus as defined in claim 24, wherein said applying means comprises a leading end on each plunger which contacts the web and transfers the entrained printing medium to the same on advancement of the respective plunger.

26. An apparatus for printing on a web, comprising means for confining a body of printing medium; a plurality of plungers; means mounting said plungers for reciprocation towards and away from the general plane of the web, including for each plunger a sleeve having an open end facing the web and at least one port which is openable during reciprocation of the respective plunger for communication of the interior of the sleeve with said body of printing medium; means for pressurizing the body of printing medium to speed its entry into the sleeves through the opened ports; means for retracting said plungers in direction away from the web to segregate a metered quantity of printing medium from said body, and for thereafter advancing the plungers towards the web; and means for applying the segregated printing medium to the web prior to subsequent to advancing of the plungers.

27. An apparatus for printing on a web, comprising means for confining a body of printing medium of high viscosity; a plurality of plungers; means mounting the plungers for reciprocation towards and away from the general plane of the web and through the body of printing medium, including sleeves in which the respective plungers are reciprocable and which have openable ports for communication with the body of printing medium; means for temporarily arresting the respective plungers in their retracted position for a period of time sufficient for the highly viscous printing medium to enter the associated sleeves through the opened ports thereof; means for retracting said plungers in direction away from the web to segregate from the body of printing medium through said ports a metered quantity of the medium, and for thereafter advancing the plungers towards the web; and means for applying the segregated printing medium to the web prior or subsequent to advancing of the plungers.

28. An apparatus for printing on a web, comprising means for confining a body of printing medium; a plurality of plungers; means mounting said plungers for reciprocation towards and away from the general plane of the web, including for each plunger a sleeve having an open end facing the web and at least one port which is opened and closed by the associated plunger during reciprocation of the same for communication of the interior of the sleeve with said body of printing medium; means for reciprocating said plungers in said sleeves to segregate through the respective opened ports a metered quantity of the printing medium from said body; and means for applying the segregated printing medium to the web prior or subsequent to reciprocation of the plungers towards said general plane of the web.

* * * * *